United States Patent [19]

Kumata et al.

[11] Patent Number: 4,967,552

[45] Date of Patent: Nov. 6, 1990

[54] METHOD AND APPARATUS FOR CONTROLLING TEMPERATURES OF TURBINE CASING AND TURBINE ROTOR

[75] Inventors: Kazuhiko Kumata, Katsuta; Nobuyuki Iizuka, Hitachi; Masashi Kunihiro, Hitachi; Soichi Kurosawa, Hitachi, all of Japan

[73] Assignee: Hitachi, Ltd., Tokyo, Japan

[21] Appl. No.: 229,811

[22] Filed: Aug. 8, 1988

Related U.S. Application Data

[63] Continuation-in-part of Ser. No. 12,611, Feb. 9, 1987, abandoned.

[30] Foreign Application Priority Data

Feb. 7, 1986 [JP] Japan ..... 61-23823

[51] Int. Cl.[5] ..... F02C 7/18

[52] U.S. Cl. ..... 60/39.75; 415/115; 415/175

[58] Field of Search ..... 60/39.07, 39, 29, 39.75; 415/115, 116, 117, 175, 176, 177

[56] References Cited

U.S. PATENT DOCUMENTS

| | | | |
|---|---|---|---|
| 4,019,320 | 4/1977 | Redinger et al. | 60/39.75 |
| 4,137,705 | 2/1979 | Andersen et al. | 60/39.75 |
| 4,807,433 | 2/1989 | Maclin et al. | 415/115 |
| 4,815,928 | 3/1989 | Pineo et al. | 415/115 |

FOREIGN PATENT DOCUMENTS

| | | | |
|---|---|---|---|
| 87212 | 11/1973 | Japan . | |
| 126034 | 7/1984 | Japan | 415/115 |
| 111104 | 5/1987 | Japan . | |

*Primary Examiner*—Louis J. Casaregola

*Attorney, Agent, or Firm*—Antonelli, Terry, Stout & Kraus

[57] ABSTRACT

A method and apparatus for controlling a temperature of a turbine casing and a turbine rotor in a gas turbine, which method and apparatus enables a maintaining of an optimum gap at a tip end of the rotor blades of the gas turbine over an entire operating range by independently controlling the amounts of heat energy supplied to a space of the turbine casing and the turbine rotor.

22 Claims, 7 Drawing Sheets

METHOD AND APPARATUS FOR CONTROLLING TEMPERATURES OF TURBINE CASING AND TURBINE ROTOR

This application is a continuation-in-part of application Ser. No. 012,611, filed Feb. 9, 1987 (abandoned).

BACKGROUND OF THE INVENTION

The present invention relates to a gas turbine and, more particularly, to a gas turbine wherein air discharged from or extracted by a compressor is introduced to a turbine section to control temperatures of the turbine casing and a turbine rotor thereby maintaining an optimum gap at the tip end of the rotor blades of the gas turbine over an entire operating range so as to provide for a high efficiency operation of the gas turbine.

In, for example, Japanese Patent Laid Open Application No. 48-87212, a controlling air system is proposed wherein a portion of the air discharged from a compressor is introduced into a gas turbine for cooling the gas turbine.

SUMMARY OF THE INVENTION

The aim underlying the present invention essentially resides in providing a method and apparatus for controlling a temperature of a turbine casing and rotor in a gas turbine by which it is possible to maintain an optimum gap at a tip end of the rotor blades of the gas turbine over an entire operating range by independently controlling amounts of heat energy to be supplied to spaces of the turbine casing and turbine rotor.

The present invention provides both a method and apparatus which are capable of controlling the flow rate and the temperature of the temperature controlling air individually with respect to temperature controlling air for the rotor side and temperature controlling air for the casing side in accordance with load, starting, and operating conditions of the turbine whereby it is possible to minimize the size of the gap at the tip end of the rotor blades and minimize the flow rate of cooling air at values conforming to minimum necessary values thereby improving the overall operating efficiency of the gas turbine. The operating characteristics and constructional features of the gas turbine are designed so as to obtain an optimum efficiency during the rated operation; therefore, a decrease in an output ratio causes a reduction in the overall efficiency of the gas turbine. The reduction in efficiency is influenced by a drop in the turbine efficiency and, additionally, the efficiency reduction is greatly influenced by an increase in a dimension of the gap at the tip end of the rotor blades and by an unnecessarily high flow rate of the cooling air. Since a gas turbine is, as a practical matter, more often operated in a partial loaded condition than in a rated loaded condition, the degree of efficiency during a partial loaded condition affects the overall level of performance of the gas turbine.

One major obstacle to a minimization of the size of the gap at the tip end of the rotor blades, as noted above, is the phenomenon of overshoot which is caused by the difference between the speeds at which the rotor side of the turbine section and casing side of the same are radially displaced during a rapid transient state such as, for example, a start of operation of the gas turbine. An occurrence of an overshoot has not been completely prevented by prior art proposals wherein the temperature and flow rate of the temperature controlling air are adjusted to remain at a constant value.

According to the present invention, in order to prevent an occurrence of the phenomenon of overshoot, the cooling capacity of the cooling air portion supplied to the rotor side and the casing side are controlled in accordance with starting characteristics and operating condition parameters of the gas turbine so that the speeds at which a radial displacement of the rotor side and casing side take place are always maintained so as to be substantially the same.

More particularly, in accordance with advantageous features of the present invention, an apparatus for controlling temperatures of a turbine casing in a turbine rotor is provided which includes a gas turbine having a turbine casing and a turbine rotor rotatably disposed in the turbine casing, and a high temperature gas passage means disposed between the turbine casing and the turbine rotor. Means are provided for supplying air having a controlled temperature through a first controlling means for controlling a temperature of the air to a space formed in the turbine casing, and means are also provided for supplying air having a controlled temperature through a second controlling means for controlling a temperature of the air to a spaced formed in the turbine rotor, with the spaces in the turbine casing and turbine rotor communicating with the high temperature gas passage means. Means are provided for controlling, amounts of heat energy to be supplied through the first and second supply means to the spaces of the turbine casing and turbine rotor whereby the amounts of heat energy to be supplied to the space of the turbine casing is independently controlled from the amounts of heat energy supplied to the turbine rotor.

In accordance with still further features of the present invention, the means for supplying the compressed air having a controlled temperature to the space formed in the turbine casing increases the temperature of the turbine casing to a predetermined temperature, with the means for supplying the compressed air to the space formed in the turbine rotor increasing a temperature of the turbine rotor so that it is possible to equally adjust respective speeds of thermal expansion of the turbine casing and the turbine rotor.

Advantageously, according to the invention, a detecting means may be provided for detecting an exhaust gas temperature of the gas turbine, with the controlling means, in response to the output signals of the exhaust gas temperature detecting means enabling independent control of the amount of heat energy supplied to the space of the turbine casing and the space of the turbine rotor whereby speeds of thermal expansion of the turbine rotor and speeds of thermal expansion of the turbine casing and turbine rotor are substantially equally adjusted and a flow rate of the compressed air may be controlled to a minimum necessary value with respect to the output ratios of the turbine.

In accordance with advantageous features of the method of the present invention, compressed air, from a compressor means connected to the gas turbine, having a controlled temperature is supplied through a first controlling means for controlling a temperature of the compressed air to a space formed in the turbine casing and the compressed air having the controlled temperature is also supplied to a second controlling means for controlling a temperature of the compressed air to a space formed in the turbine rotor, with the spaces formed in the turbine casing and turbine rotor communicating with a high temperature gas passage means.

By virtue of the control features of the present invention, it is possible to minimize the dimension of the gap at the tip end of the rotor blades thereby improving the overall efficiency of the gas turbine.

Furthermore, it is possible by virtue of the present invention to constantly maintain a minimum necessary gap at the tip end of the rotor blade during a partial load operation thereby improving the efficiency of the gas turbine during a partial load operation.

Moreover, it is also possible in accordance with the present invention to control the flow rate of the temperature controlling air which control is significant in attempting to reduce one of the causes of a drop in efficiency during a partial load operation of the gap turbine, with the temperature controlling air being provided at a minimum value thereby further enhancing the degree of efficiency during partial load operation.

DETAILED DESCRIPTION

Figure 1:
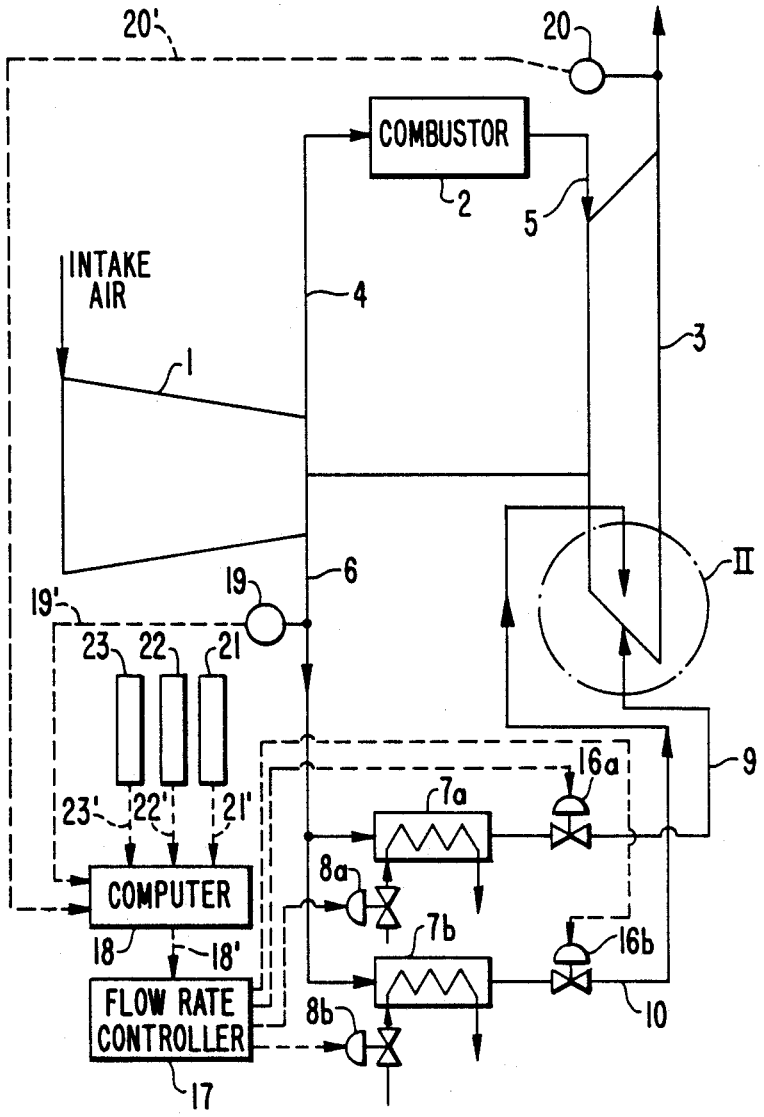
FIG. 1 is a schematic view of a gas turbine system of the present invention.
Figure 2:
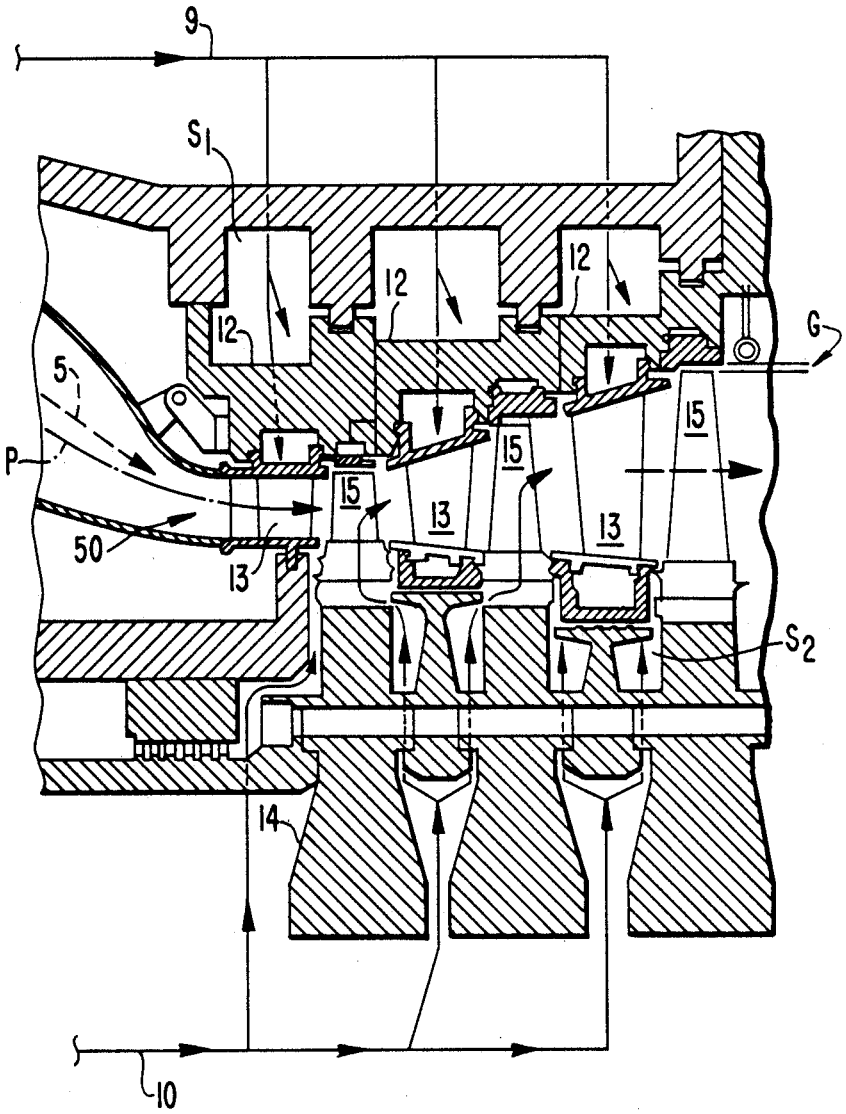
FIG. 2 is a cross-sectional view, on an enlarged scale, of a portion designated II in FIG. 1.

Referring now to the drawings wherein like reference numerals are used throughout the various views to designate like parts and, more particularly, to FIGS. 1 and 2, according to these figures, the method and apparatus for controlling a temperature of a casing and rotor in accordance with the present invention is applied to a gas turbine including a compressor 1, combustor 2, and turbine 3, with a portion of air discharged from the compressor 1 being led outside of the compressor 1 as temperature controlling air 6 and being separately led through an intercooler 7*a* and an intercooler 7*b* provided exteriorly of the compressor 1, with a remaining portion of the discharged air being supplied as intake or combustion air 4 to the combustor 2. High pressure combustion gas 5 is introduced into the turbine 3 wherein the thermal energy is converted into mechanical energy and discharged from the turbine 3. The intercooler 7*a* is provided for treating an air portion for controlling the temperature of the turbine casing 12 of the turbine 3 and the intercooler 7*b* is provided for treating an air portion for controlling the temperature of a rotor 14 of the turbine 3. Thereafter, the air portions are introduced to the side of the casing 12 of the turbine 3 and to the side of the rotor 14 of the turbine 3, respectively.

As shown most clearly in FIG. 2, the air portion which flows to the side of the turbine casing 12 is introduced to an interior of the turbine casing 12 and is employed for preheating the turbine casing 12 when the turbine 3 is in a cold condition and, when the turbine 3 is in a warm condition, for cooling the turbine casing 12 and stationary blades 13 disposed radially inwardly of the turbine casing 12 and in a high temperature gas path P passing through a high temperature gas passage 50 disposed between the turbine casing 12 and turbine rotor 14, and for preventing a backflow of the combustion gas from the high temperature gas path P. The so supplied air then converges into the gas path P. The air portion which flows to the side of the turbine rotor 14 is introduced to the interior of the rotor turbine 14 where it is employed for preheating the turbine rotor 14 when the rotor 14 is cold and, when the turbine rotor 14 is warm, for cooling the turbine rotor 14 and rotor blades 15 disposed on an outer periphery of the turbine rotor 14 and disposed in the high temperature gas path P, as well as for preventing a backflow of the combustion gas from the high temperature gas path P. Then the used air converges into the gas path P.

As shown in FIG. 1, the intercoolers 7*a*, 7*b* are provided with refrigerant flow rate control valves 8*a*, 8*b*, respectively, for controlling the temperatures of the temperature controlling air with the coolers 7*a*, 7*b* also being provided with controlling air flow rate control valves 16*a*, 16*b*, respectively, for controlling the flow rate of the temperature controlling air. The control apparatus is provided with a flow rate control valve controller 17 and computer means 18, both of a conventional construction, for controlling the temperature controlling air system which includes the flow rate control valves 8*a*, 8*b*, 16*a*, and 16*b*. The computer means 18 is supplied with a discharge air pressure signal 19' from the compressor discharge air pressure detector means 19, an exhaust gas temperature signal 20' from a turbine exhaust gas temperature detecting means 20, start-stop sequence signals 21' indicative of an operating condition of the gas turbine, from a detecting means 21, a turbine casing metal temperature signal 22' from a turbine casing metal temperature detecting means 22, and an ambient temperature signal 23' from an ambient temperature detecting means 23, with the computer means 18 providing an output signal 18' based on the above supplied signals to the flow rate controller 17 which, in turn, provides output signals to the refrigerant control rate control valves 8*a*, 8*b* and the air flow control rate valve 16*a*, 16*b* for controlling the flow rate and temperature of the cooling air.

A gas turbine may be hypothetically divided into several portions with respect to the blades. Gas temperatures at portions of respective blades are proportional to an output of the gas turbine. If the relationship between the output of the gas turbine and the temperatures at the respective portions are experimentally determined beforehand, the temperatures at the respective portions may be determined by measuring the actual output of the gas turbine during operations at a full load and/or partial loads and computing the temperatures at the respective portions.

On the other hand, the temperatures at the respective portions may also be determined by measuring a rotational speed of the gas turbine at starting operation and computing the temperatures of the respective portions.

If the temperatures at the respective portions are determined, temperatures of rotor blades and stationary blades are automatically determined. As a result, the thermal expansion of the blades are determined by simple calculations such as $\Delta T \times \alpha = \Delta l$ where $\Delta T$ is a temperature difference of the blades, $\alpha$ is a coefficient of thermal expansion and $\Delta l$ is a difference in length of the blades.

A thermal expansion of the casing can be determined by detecting a temperature of the casing metal in the same way as mentioned above.

As to thermal expansion of the rotor, it is determined by detecting the ambient temperature and computing the expansion in the same manner mentioned above.

The gap (G) at the tips of the blades is calculated by the following equation:

G = Initial gap at room temperature
− thermal expansion of blades
− thermal expansion of turbine rotor
− centrifugal stretching of turbine rotor
+ thermal expansion of turbine casing.

Figure 7:
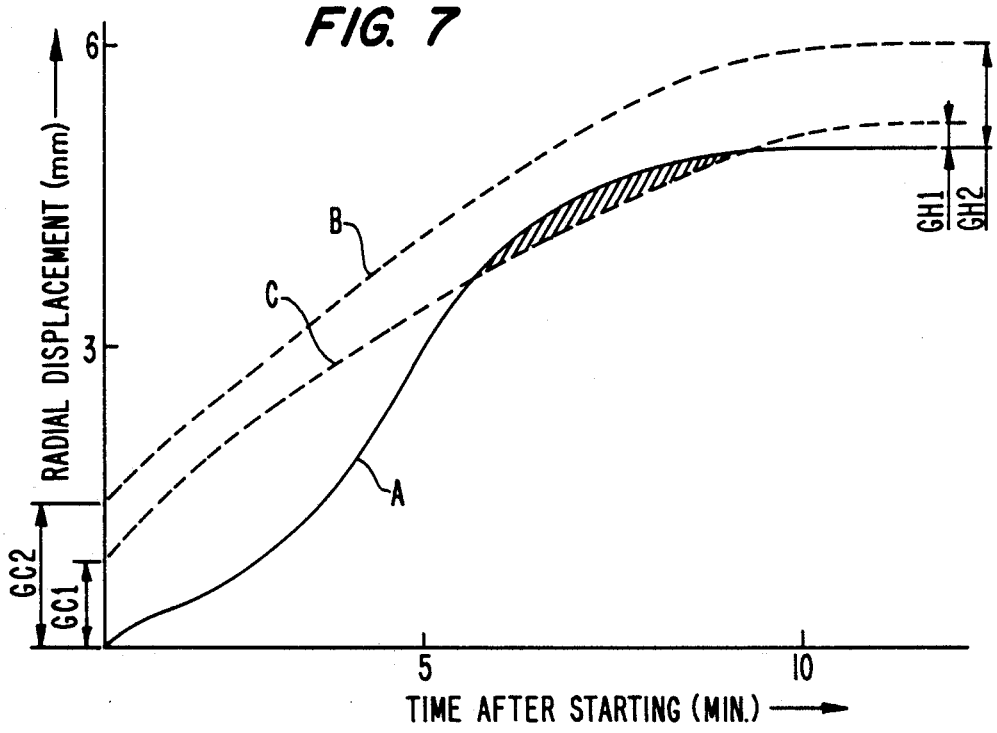
FIG. 7 is a graphical illustration of the gap characteristics at the time of a start-up of the gas turbine.

The phenomenon of an overshooting is explained with respect to FIG. 7. More particularly, after starting the gas turbine, the rotor blades 15, located in a high temperature gas path, thermally rapidly expand in proportion to an increase in the temperature of the combustion gas. The thermal expansion of the rotor blades 15 is combined with a gradual thermal expansion of the turbine rotor 14 and a centrifugal stretching, and, as a result, the radial displacement experienced by the rotor side of the turbine 3 changes with time.

When a minimum necessary gap value GH1 for the normal operating condition of the turbine is determined taking into consideration the above noted factors affecting the size of the gap, the radial displacement experienced by the shroud segments of the turbine changes with time; however, because of the rapid expansion of the rotor blades 15 and the difference between the mass of the turbine casing 12 and that of the turbine rotor 14, the displacement experienced by the rotor side of the turbine 3 precedes that of the casing side of the same causing an overshoot, represented by the hatched portion in FIG. 7, at a certain point in time after a start-up operation of the gas turbine.

In prior art proposals, a gap value of GC2 for the assembly of the turbine was determined in consideration of minimizing the characteristics concerning the phenomenon of an overshoot together with the other factors noted above so that the size of the gap G would have a value of GH2 during a normal operation condition of the turbine.

Figure 8:
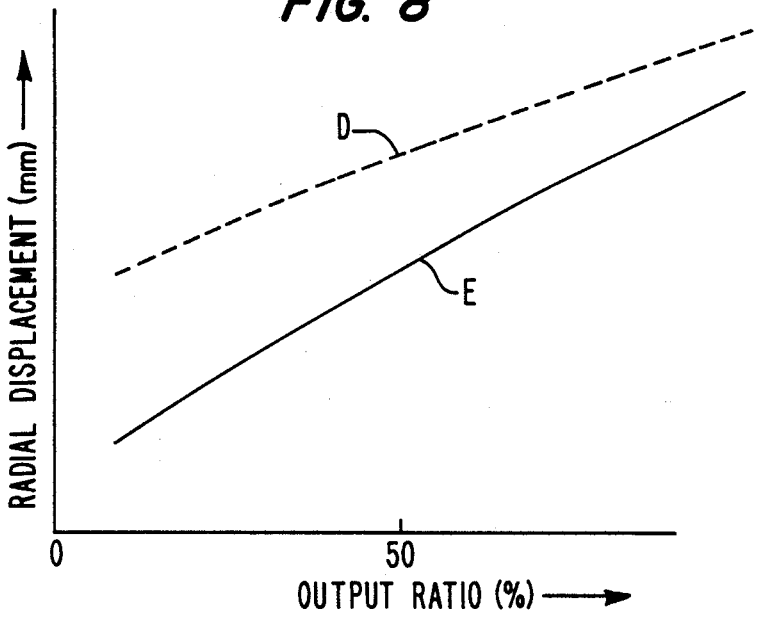
FIG. 8 is a graphical illustration of the gap characteristics during normal operation of the gas turbine.

FIG. 8 provides a graphical illustration of the displacement D of the casing side and the displacement E on the rotor side relative to an output ratio of the turbine. As shown in FIG. 8, as the output ratio decreases and the combustion temperature drops accordingly, the amount of displacement D, E in both the casing and the rotor sides are reduced, with the drop in the combustion temperature affecting the rotor side more than the casing side since the rotor side is directly located in the high temperature gas path. Therefore, the gap G at the tip end of the rotor blades 15 has a tendency to enlarge as the output ratio decreases.

Figure 9:
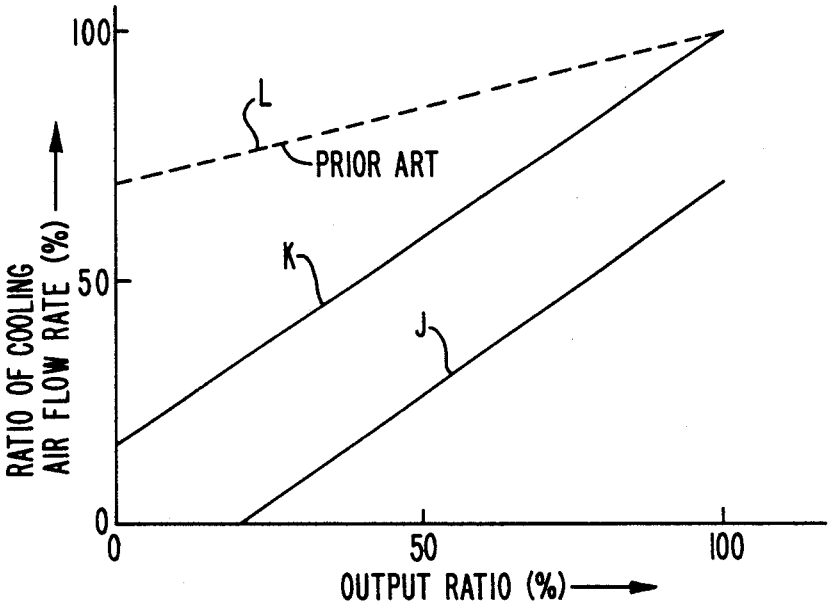
FIG. 9 is a graphical illustration of the characteristics of the cooling air flow rates.

FIG. 9 provides a graphical illustration of a ratio of the temperature controlling air flow rate relative to the output ratio. In gas turbines, heat-resist alloys used for the stationary blades 13 and the rotor blades 15 usually have an allowable upper limit temperature on the order of about 800° C. A supply of controlling air is necessary when the stationary blades 13 and the rotor blades 15 are exposed to combustion gas of a temperature exceeding the allowable upper limit temperature. Conversely, temperature controlling air for the blades becomes unnecessary when the output ratio decreases so that the combustion temperature becomes no more than the allowable upper limit temperature. The minimum flow rate of temperature controlling air which is necessary for cooling the blades is designated by the reference character J. The temperature controlling air not only cools the stationary blades 13 and rotor blades 15 but also cools the casing 12 and the rotor 14 and seals off the backflow of combustion gas from the high-temperature gas path. Therefore, there is a minimum necessary flow rate of the temperature controlling air relative to the output of the turbine, with such minimum necessary flow rate being represented by the reference character K in FIG. 9. However, in previous proposals, since the flow rate of the temperature controlling air is adjusted by orifices having a diameter which are set so as to provide a flow rate which is appropriate for a rated operation, the temperature controlling air flows at an actual rate designated by the reference character L in FIG. 9 with respect to the output ratio of the turbine. As a result, unnecessary surplus air flows in an amount corresponding to a difference between the actual cooling air flow rate L and the minimum necessary cooling air flow rate K.

Figure 3:
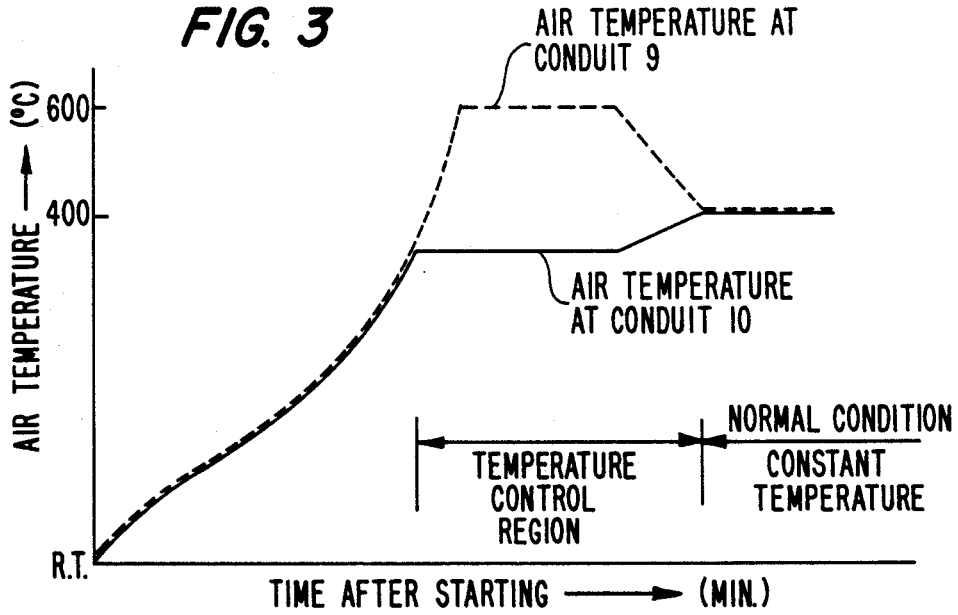
FIG. 3 is a graphical illustration of characteristics of the temperature of the cooling air at a start of a turbine operation.

FIG. 3 provides a graphical illustration of the temperature of the controlling air at the start of a turbine operation. More particularly, during a start-up operation, in order to prevent the occurrence of an overshoot in the gap at the tip end of the rotor blades 15, the following control operations are effected so that the speed at which the casing side of the turbine 3 radially displaces is not lower than that at which the rotor side radially displaces. During the process of an increase in the load at a starting operation, the temperature of the temperature controlling air for the rotor side is set to a value less than a set temperature value for a rated operation of the turbine, while the temperature of the temperature controlling air for the casing side is set to a value larger than a set temperature value for the rated operation of the turbine so as to increase a radial displacement speed of the casing side. After the overshoot region is passed, the temperature values of the controlling air are gradually brought to the optimum temperature values for the rated operation and maintained at such temperature.

In order to obtain the characteristic shown in FIG. 3, in accordance with the present invention, the refrigerant flow rate control valves **8*a*, 8*b* and the controlling air flow rate control valves 16*a*, 16*b* are controlled in response to a gas turbine start sequence-signal inputted to the computing means 13 in the following manner. The control valves 16*a* and 16*b* are maintained with relatively small constant openings until the gas turbine reaches the normal operation, and the control valves 8*a***, 8b remain fully closed or slightly opened from a point in time immediately after the start-up operation to a point in time where a temperature control region begins.

After a start-up of the gas turbine, since the rotational speed of the compressor 1 increases with the increase in the rotational speed of the turbine 3, the temperature of the air discharged from the compressor 1 increases, and the temperature of the air supplied to the intercooler 7a, 7b also increases accordingly. After a start-up, the opening of the refrigerant flow rate control valve 8b provided for the intercooler 7b treating the controlling air for the rotor side is made larger than that of the other control valve 8a, so that the temperature of the temperature controlling air for the rotor side is less than that of the temperature controlling air for the casing side as shown in FIG. 3. The temperature differential between the temperature controlling air portions is determined in accordance with the respective heat capacities of the rotor 14 and the casing 12, and the turbine metal temperature for the exhaust gas temperature so that a value suitable for preventing the occurrence of an overshoot graphically illustrated in FIG. 7 can be determined.

When the gas turbine reaches a normal operating condition, both the casing side and rotor side of the turbine 3 thermally expand; therefore, the refrigerant is supplied to the intercooler 7a, 7b at a maximum rate so as to perform a cooling of the casing side and rotor side by cooling air portions having substantially the same temperature. Since the necessary amount of temperature controlling air for controlling temperature of the casing 12 varies in accordance with the ambient temperature of the gas turbine, the temperature or flow rate of the controlling air for the casing 12 may be corrected by an ambient temperature signal inputted to the computing means 18.

Figure 4:
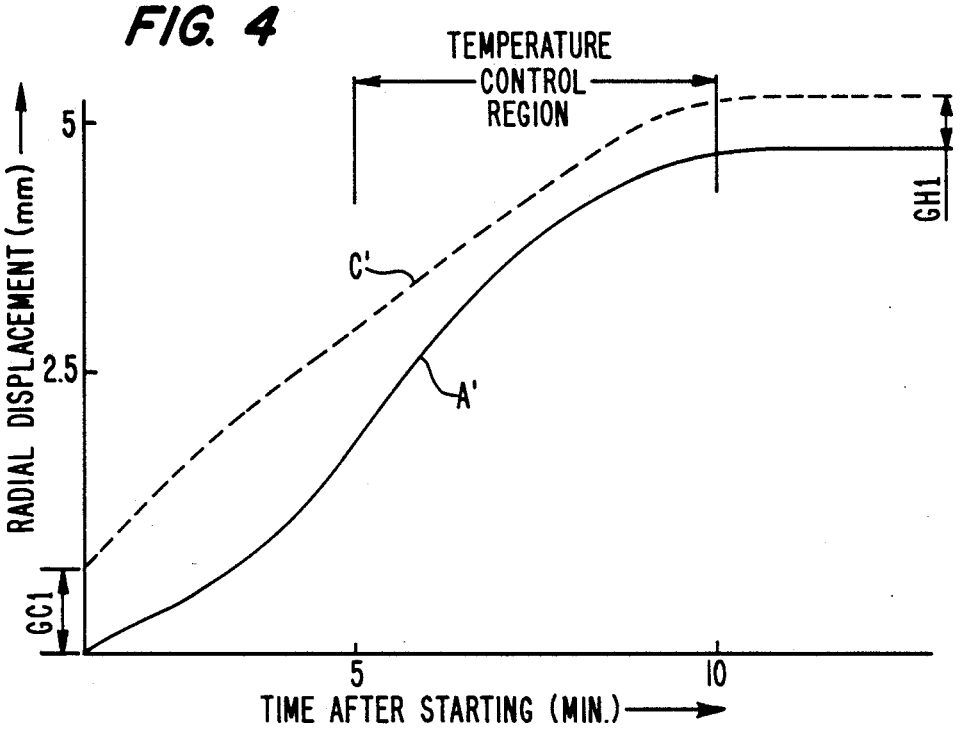
FIG. 4 is a graphical illustration of the characteristics of the gap obtained by virtue of the method and apparatus of the present invention.

FIG. 4 provides an example of the radial displacement of the casing and the rotor when the temperature control system of FIG. 3 is effected. More particularly, as shown in FIG. 4, since the amount of radial displacement A' of the rotor 14 is always less than that of the radial displacement C' of the casing 12, the size of the gap between the casing 12 and the rotor 14 during normal operation can be set at a small value GH1.

More particularly, by setting the temperature of the temperature controlling air for the rotor side at a relatively low value, the speed at which the radial displacement A' of the rotor 14 takes place becomes lower than that at which the radial displacement A (FIG. 7) of the rotor occurs and, conversely, the speed at which the radial displacement C' of the casing takes place becomes higher than at which the radial displacement C (FIG. 7) of the casing 12 occurs, with this being achieved by setting the temperature of the temperature controlling air for the casing side at a relatively high value. Therefore, at a start-up operation of the turbine, it is possible to ensure that the size of the gap at a tip end of the rotor blades 15, which is always larger than a predetermined value, thereby making it possible to set the size of the gap at a necessary minimum value GH1 for a normal operation of the turbine.

Since the temperature controlling air is used for cooling the rotor blades 15, the stationary blades 13, the rotor 14, and the casing 12, and for preventing a backflow of the combustion gas from the high-temperature gas path, as the output ratio of the gas turbine decreases, the combustion temperature also decreases and, in proportion thereto, the necessary flow rate for the temperature controlling air for cooling the rotor blades 15, stationary blades 13, casing 12, and rotor 14 decreases. Additionally, with a decrease in the output ratio, since the pressure in the gas path decreases, the flow rate of sealing air for the prevention of a backflow can be reduced. Therefore, if the flow rate of the temperature controlling or cooling air is controlled at a minimum necessary value, it is also possible after the turbine is shifted to a normal operating condition, to eliminate a consumption of surplus cooling air thereby considerably improving the overall degree of efficiency of the gas turbine.

In general, the flow rate of the temperature controlling air changes substantially in proportion to changes in an output ratio of the gas turbine. In the embodiment of FIGS. 1 and 2, the opening of the flow rate control valve 16a, 16b are determined in accordance with the exhaust gas temperature signal from the exhaust gas temperature sensor or detector 20 and the sequence signals 21 by the computing means 18 so that the characteristics can be obtained in accordance with the loaded condition of the turbine, which is substantially indicated by the exhaust gas temperature signal. By effecting this control, the degree of efficiency at a low load operating condition can be significantly improved.

Since a cooling capacity of the temperature controlling air changes in accordance with the temperature and flow rate thereof, the desired cooling capacity of the temperature controlling air described above can be obtained by changing the temperature of the temperature controlling air with the flow rate being maintained at a constant level.

Figure 5:
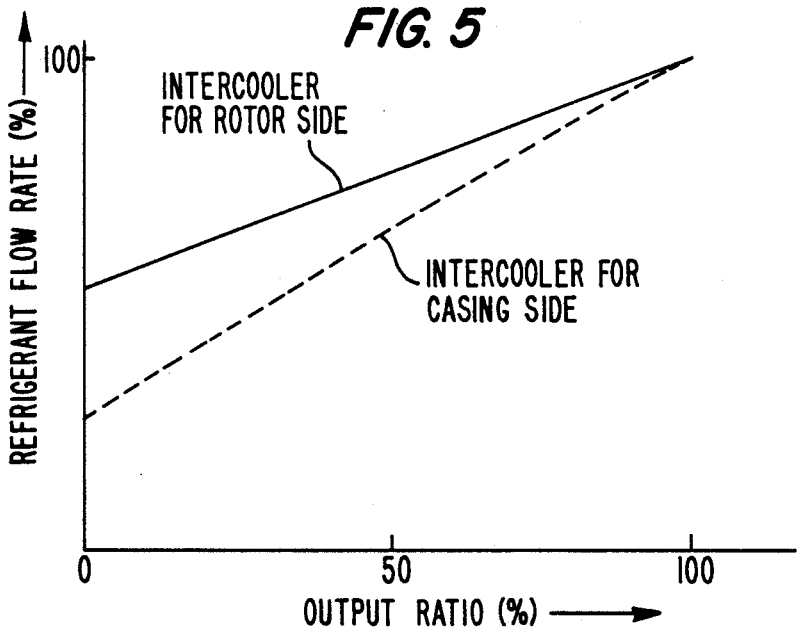
FIG. 5 is a graphical illustration of the characteristics of the flow rate of the refrigerant during a normal operation.

More particularly, FIG. 5 provides a graphical illustration of the manner by which it is possible to change a flow rate at which the refrigerant is supplied to the intercooler 7a, 7b for the purpose of changing the temperature of the temperature controlling air. More specifically, the openings of the refrigerant flow rate control valves 8a, 8b are varied so as to increase the refrigerant flow rate as the load of the turbine increases. Thus, the higher the load of the turbine, the lower the temperature of the temperature controlling air. However, when effecting control in this manner, there is a concern that a large temperature differential will occur between the cooled surfaces and the heating surfaces thereby creating the problems of thermal stress. In order to eliminate the occurrence of a large temperature differential, the temperature of the temperature controlling air may be raised as the load increases while the flow rate of the temperature controlling air is also increased thereby increasing the total quantity of heat dissipated by the temperature controlling air.

As noted above, it is possible in accordance with the present invention to maintain a gap at the tip end of the rotor blades 15 at the minimum necessary distance over the entire operating range of the gas turbine and to control the flow rate of the temperature controlling air at minimum values in accordance with output ratios of the turbine thereby improving the overall efficiency of the gas turbine over the entire operating range thereof.

Figure 10:
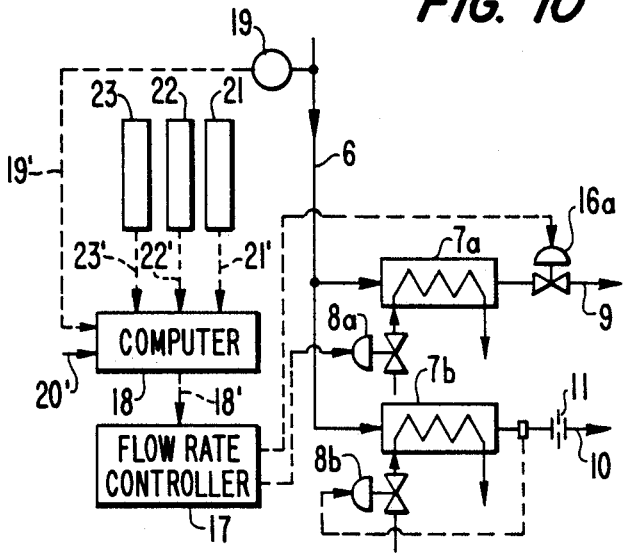
FIG. 10 is a schematic view of a portion of another embodiment of an apparatus for controlling cooling air constructed in accordance with the present invention.
Figure 11:
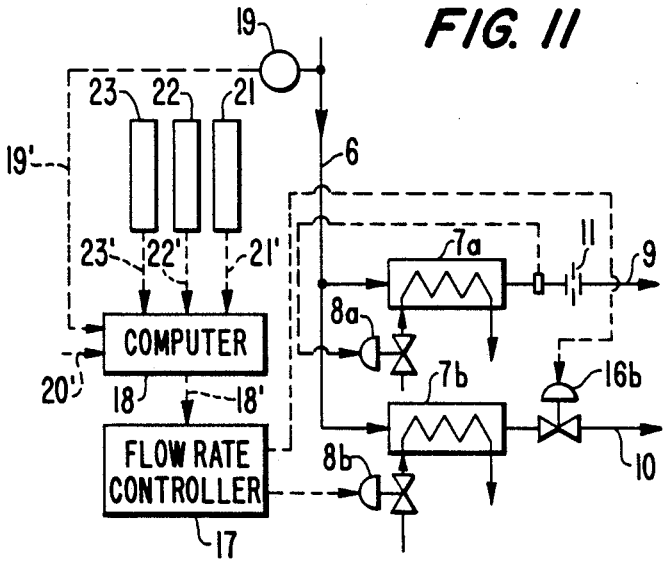
FIG. 11 is a schematic view of a portion of a further embodiment of an apparatus for controlling cooling air constructed in accordance with the present invention.

As shown in FIG. 10, it is also possible in accordance with the present invention to substitute an orifice 11 for the air flow rate control valve 16b on the casing side, with the flow rate of the temperature controlling air for the rotor side being carried out by the air flow rate control valve 16a. Conversely, as shown in FIG. 11, it is also possible to provide an orifice 11 for the air flow rate control valve 16a on the rotor side, with the flow rate of the temperature controlling air for the casing side being carried out by the air flow rate control valve 16b. The embodiments of FIGS. 10 and 11 have the same advantageous effects as the embodiment of FIG. 1; however, the control ranges are somewhat narrower than the embodiment of FIG. 1.

Figure 12:
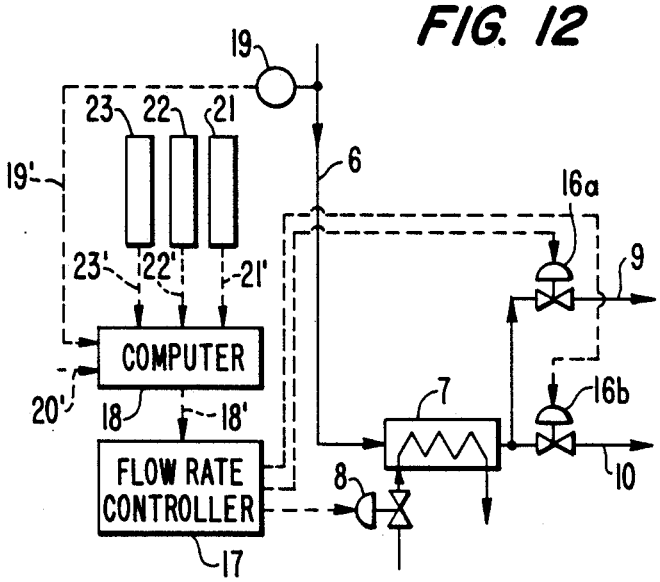
FIG. 12 is a schematic view of a portion of yet another embodiment of an apparatus for controlling cooling air constructed in accordance with the present invention.

As shown in FIG. 12, it is also possible according to the present invention to provide a single intercooler 7, with the temperature controlling air being divided into temperature controlling air 9 for the turbine casing 12 and temperature controlling air 10 for the turbine rotor 14 at the exit of the intercooler 7, and with the flow rate control valves 16a, 16b being arranged in respective pipes or conduits. By virtue of this arrangement, by fixing the temperature of the controlling air and varying a proportion of the respective portions of the temperature controlling air, the same advantageous effects described above in connection with the embodiments of FIG. 1 can be obtained.

As described above, the present invention enables the radial displacement of the rotor side of the turbine section of a gas turbine and the casing side of a gas turbine to be controlled by individually controlling the temperatures and the flow rates of the respective portions of temperature controlling air for the turbine rotor 14 and the turbine casing 12, so that it is possible to prevent any occurrence of an overshoot during the course of a start-up operation of the gas turbine, thereby setting the gap at the tip end of the rotor blades 15 at a minimum necessary value during a rated operation of the gas turbine. Furthermore, the present invention enables the size of the gap G at the tip end of the rotor blades 15 to be maintained at a minimum necessary value relative to the output ratios of the gas turbine. Additionally, the flow rate of the controlling air can be controlled at minimum necessary values relative to the output ratios of the gas turbine. Therefore, the degree of efficiency can be improved over the entire operating range of the gas turbine.

In general, the effect of the reduction of the dimension of the gap G at the tip end of the rotor blades 15 on the improvement of the efficiency of the gas turbine may be expressed in accordance with the following relationship:

$$\frac{\text{Gap Reduction Dimension}}{\text{Length of the Moving Blade}} \times 0.8.$$

Therefore, if the rotor blade 15 has a length of, for example, 75 mm, and the gap G is reduced by 0.5 mm, the overall efficiency of the gas turbine can be improved by 0.5%.

Furthermore, by reducing the amount of the controlling air by 50% during a partial load operation, the efficiency of the gas turbine can be improved by 1.1%.

Figure 6:
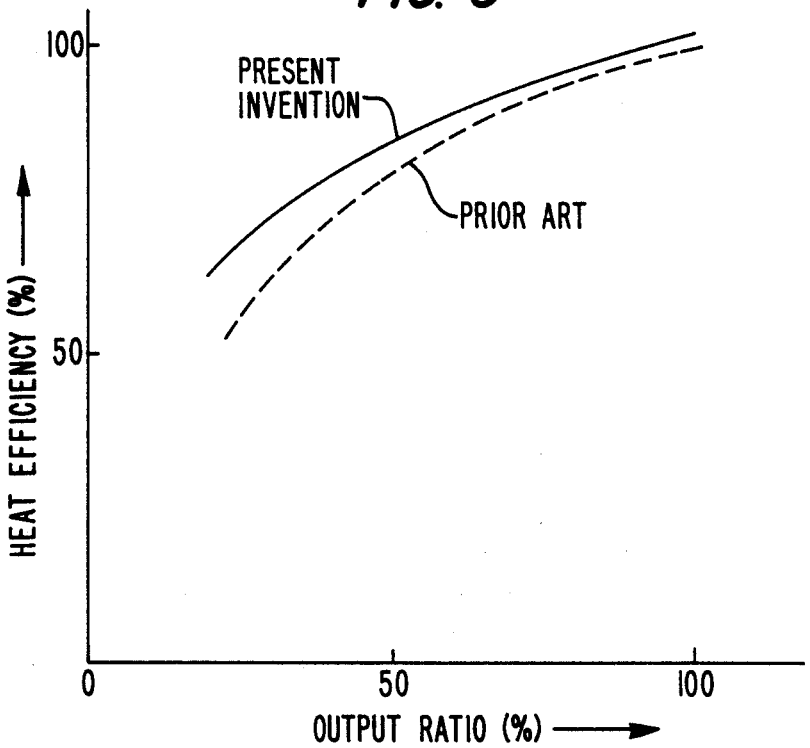
FIG. 6 is graphical illustration of the heat efficiency characteristic.

The improvement of the efficiency of the gas turbine in accordance with the present invention is graphically illustrated in FIG. 6. More particularly, FIG. 6 shows the efficiency ratios of the present invention and the efficiency ratios of the prior art relative to the output ratios when the heat efficiency ratio of the prior art attained at an output ratio of 100% is taken at 100% heat efficiency.

When the output ratio is 100%, the effect of reduction of the size of the gap G at the tip end of the rotor blades 15 to the minimum necessary value is provided. As the output ratio decreases, the effect of minimization of the size of the gap G is supplemented by the effect of the reduction of the flow rate of the temperature controlling air, and thus the rate at which the efficiency is improved can be further enhanced.

While we have shown and described several embodiments in accordance with the present invention, it is understood that the same is not limited thereto but is susceptible to numerous changes and modifications as known to one having ordinary skill in the art and we therefore do not wish to be limited to the details shown and described herein, but intend to cover all such modifications as are encompassed by the scope of the appended claims.

We claim:

1. An apparatus used in a gas turbine having a turbine casing, a turbine rotor rotatably disposed in said turbine casing, a high temperature gas passage disposed between said turbine casing and said turbine rotor, and means for compressing intake air supplied to the gas turbine as compressed air, to control temperatures of the turbine casing and the turbine rotor, the apparatus comprising:

first means for supplying said compressed air through first controlling means for controlling a temperature of said compressed air to a space formed in said turbine casing;

second means for supplying said compressed air through second controlling means for controlling a temperature of said compressed air to a space formed in said turbine rotor, said spaces formed in said turbine casing and said turbine rotor communicating with said high temperature gas passage; and means for controlling amounts of heat energy to be supplied to said spaces formed in said turbine casing and said turbine rotor through said first and second means for supplying compressed air, whereby the amount of heat energy supplied to said space formed in said turbine casing is independently controlled from the amount of heat energy supplied to said space formed in said turbine rotor.

2. An apparatus according to claim 1, wherein said first and second means for supplying compressed air includes at least one intercooler means for receiving the compressed air from said means for compressing and supplying the same to said first and second means for controlling a temperature of said compressed air.

3. An apparatus according to claim 2, wherein said first and second controlling means includes at least two air flow rate control valve means disposed downstream of said at least one intercooler means for controlling the air flow rate of the temperature controlling air to the space formed in the turbine casing and the space formed in the turbine rotor.

4. An apparatus according to claim 2, wherein said means for controlling amounts of heat energy supplied includes means for detecting an exhaust gas temperature of said gas turbine and supplying an output signal representative thereof, computer means for receiving the output signal from said means for detecting and for generating a control signal, and flow rate control means for controlling a position of at least two air flow control rate valve means positionable in response to said control signal from said computer means.

5. An apparatus according to claim 3, wherein said means for controlling amounts of heat energy supplied further include at least one coolant flow rate control valve means in communication with said at least one intercooler means on an upstream side of said at least one intercooler means, and a flow rate controller means for providing a controlling signal to said at least one coolant flow rate control valve means to control a positioning thereof.

6. An apparatus according to claim 1, wherein said first and second means for supplying compressed air includes at least two intercooler means for receiving the compressed air from said means for compressing and supplying the same to said first and second means for controlling temperature.

7. An apparatus according to claim 6, wherein said first and second means for controlling temperature respectively include a pair of coolant flow rate control valve means disposed upstream of the at least two intercooler means, and a pair of air flow rate control valve means disposed downstream of the at least two intercooler means.

8. An apparatus according to claim 7, wherein said means for controlling amounts of heat energy supplied includes means for detecting an exhaust gas temperature of said gas turbine and supplying an output signal representative thereof, computer means for receiving the output signal from said means for detecting and for generating a control signal, and flow rate controller means for controlling a position of said pair of air flow rate control valve means and pair of coolant flow rate control valve means in response to said control signal from said computer means.

9. An apparatus according to claim 6, wherein said first means for controlling temperature includes an air flow rate control valve means disposed downstream of one of said at least two intercooler means, and wherein said second means for controlling temperature includes a flow rate control orifice means disposed downstream of the other of said at least two intercooler means.

10. An apparatus according to claim 9, wherein said means for controlling amounts of heat energy supplied includes means for detecting an exhaust gas temperature of said gas turbine and supplying an output signal representative thereof, computer means for receiving the output signal from said means for detecting and for generating a control signal, and a flow rate controller means for controlling a position of the air flow rate control valve means in response to said control signal from said computer means.

11. An apparatus according to claim 10, wherein said first and second means for controlling temperature include at least two coolant flow rate control valve means respectively disposed upstream of said at least two intercooler means, and wherein said flow rate controller means provides a controlling signal to said at least two coolant flow rate control valve means.

12. An apparatus according to claim 5, wherein said first and second means for supplying compressed air includes at least two intercooler means, said first means for controlling temperature includes a flow rate control orifice means disposed downstream of one of said at least two intercooler means, and the second means for controlling temperature includes an air flow rate control valve means disposed downstream of the other of said at least two intercooler means.

13. An apparatus according to claim 12, wherein said means for controlling amounts of heat energy supplied includes means for detecting an exhaust gas temperature of said gas turbine and supplying an output signal representative thereof, computer means for receiving the output signal from a said means for detecting and for generating a control signal, and flow rate controller means for controlling a position of the flow rate control valve means in response to said control signal from said computer means.

14. An apparatus according to claim 13, wherein said first and second means for controlling temperature include at least two coolant flow rate control valve means respectively disposed upstream of said at least two intercooler means, and wherein said flow rate controller means provides a controlling signal to said at least two coolant flow rate control valve means.

15. An apparatus according to claim 2, further comprising detecting means for detecting an exhaust gas temperature of said gas turbine, and wherein said means for controlling amounts of heat energy includes computer means for receiving output signals from said means for detecting, and flow rate controller means for controlling an operation of said first and second means for controlling temperature.

16. An apparatus according to claim 15, wherein said first and second means for controlling temperature includes at least two air flow rate control valve means disposed downstream of said at least one intercooler means for controlling the air flow rate to the space formed in the turbine casing and the space formed in the turbine rotor.

17. An apparatus according to claim 16, wherein said means for controlling amounts of heat energy supplied includes at least one coolant flow rate control valve means in communication with said at least one intercooler means on an upstream side of said at least one intercooler means, and wherein said flow rate controller means provides a controlling signal to said at least one coolant flow rate control valve means.

18. An apparatus according to claim 15, wherein said first and second means for supplying compressed air include at least two intercooler means for receiving the compressed air and supplying the same to said first and second controlling means for controlling temperatures.

19. An apparatus according to claim 18, wherein said first and second controlling means for controlling temperature includes a pair of coolant flow rate control valve means respectively disposed upstream of the at least two intercooler means, and a pair of air flow rate control valves disposed downstream of the at least two intercooler means.

20. An apparatus for controlling temperature of turbine casing and a turbine rotor, the apparatus comprising: a gas turbine including a turbine casing, a turbine rotor rotatably disposed in said turbine casing and a high temperature gas passage means disposed between said turbine casing and said turbine rotor, means for supplying air having a controlled temperature through first controlling means for controlling a temperature of said air to a space formed in said turbine casing; means for supplying air having a controlled temperature through second controlling means for controlling a temperature of said air to a space formed in said turbine rotor, said spaces formed in said turbine casing and said turbine rotor communicating with said high temperature gas passage means; means for controlling amounts of heat energy to be supplied to said spaces of said turbine casing and said turbine rotor through said first and second supplying means, whereby the amounts of heat energy to be supplied to said space of said turbine casing is independently controlled for the amount of heat energy to be supplied to the space of said turbine rotor.

21. An apparatus for controlling temperatures of a turbine casing and a turbine rotor, the apparatus comprising:

a gas turbine including a turbine casing, a turbine rotor rotatably disposed in said turbine casing, and a high temperature gas passage means disposed between said turbine casing and said turbine rotor;

compressor means for compressing intake air supplied to the gas turbine as compressed air;

first means for supplying said compressed air through first controlling means for controlling a temperature of said compressed air to a space formed in said turbine casing thereby increasing a temperature of said turbine casing to a predetermined temperature;

second means for supplying said compressed air through second controlling means for controlling a temperature of said compressed air to a spaced formed in said turbine rotor thereby increasing a temperature of said turbine rotor to a predetermined temperature, said spaces formed in said turbine casing and said turbine rotor communicating with said high temperature gas passage means; and means for controlling amounts of heat energy supplied to said spaces formed in said turbine casing and said turbine rotor through said first and second means for supplying, whereby the amount of heat energy supplied to said space formed in said turbine casing independently controlled from the amount of heat energy supplied to said space formed in said turbine rotor so that a speed of thermal expansion of said turbine casing and said turbine rotor is substantially equally adjusted.

22. An apparatus for controlling temperatures of a turbine casing and a turbine rotor, the apparatus comprising:

a gas turbine including a turbine casing, a turbine rotor rotatably disposed in said turbine casing, and a high temperature gas passage means disposed between said turbine casing and said turbine rotor;

compressor means for compressing intake air for the gas turbine as compressed air;

means for supplying said compressed air through first controlling means for controlling a temperature of said compressed air to a space formed in said turbine casing to thereby increase a temperature of said turbine casing through a predetermined temperature;

means for supplying said compressed air through second controlling means for controlling a temperature of said compressed air to a space formed in said turbine rotor to thereby increase a temperature of said turbine rotor to a predetermined temperature, said spaces formed in said turbine casing and turbine rotor are in communicating with said high temperature gas passage means;

detecting means for detecting an exhaust gas temperature of said gas turbine;

means for controlling amounts of heat energy supplied to said spaces formed in said turbine casing and said turbine rotor through said first and second means for supplying in response to output signals of said detecting means, whereby the amount of heat energy supplied to said space formed in said turbine casing is independently controlled from the amount of heat energy supplied to said space formed in said turbine rotor, so that a speed of thermal expansion of said turbine casing and said turbine rotor is substantially equally controlled to minimum necessary values relative to output ratios of the gas turbine.

* * * * *